US008126380B2

(12) United States Patent
Kawano et al.

(10) Patent No.: US 8,126,380 B2
(45) Date of Patent: Feb. 28, 2012

(54) IMAGE FORMING APPARATUS

(75) Inventors: Masahiro Kawano, Tokyo (JP); Tatsuya Murakami, Tokyo (JP); Yasunaga Yamaguchi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 606 days.

(21) Appl. No.: 12/237,146

(22) Filed: Sep. 24, 2008

(65) Prior Publication Data

US 2009/0080950 A1 Mar. 26, 2009

(30) Foreign Application Priority Data

Sep. 26, 2007 (JP) ..... 2007-249889

(51) Int. Cl.
*G03G 15/01* (2006.01)
*G03G 15/20* (2006.01)

(52) U.S. Cl. ..... 399/299; 399/174; 399/302; 399/313

(58) Field of Classification Search ..... 399/174, 399/299, 313
See application file for complete search history.

(56) References Cited

U.S. PATENT DOCUMENTS

| | | | | |
|---|---|---|---|---|
| 6,539,194 | B2 * | 3/2003 | Oikawa | 399/299 |
| 6,678,493 | B2 * | 1/2004 | Maeyama et al. | 399/302 |
| 6,799,908 | B1 * | 10/2004 | Park et al. | 396/604 |
| 2001/0021322 | A1 * | 9/2001 | Tsuruya et al. | 399/223 |
| 2004/0001730 | A1 * | 1/2004 | Shin | 399/296 |
| 2004/0131380 | A1 * | 7/2004 | Kuma et al. | 399/90 |
| 2004/0208678 | A1 * | 10/2004 | Yoda et al. | 399/302 |
| 2007/0172269 | A1 * | 7/2007 | Shiozawa | 399/313 |

FOREIGN PATENT DOCUMENTS

| | | |
|---|---|---|
| JP | 5-341617 | 12/1993 |
| JP | H-07-104609 | 4/1995 |
| JP | 2000-131966 | 5/2000 |
| JP | 2000-298408 | 10/2000 |
| JP | 2001-134047 | 5/2001 |
| JP | 2001-183944 | 7/2001 |
| JP | 2001-209232 | 8/2001 |
| JP | 2001-246779 | 9/2001 |
| JP | 2002-207341 | 7/2002 |
| JP | 2002-341620 | 11/2002 |
| JP | 2003-280400 | 10/2003 |
| JP | 2004-133042 | 4/2004 |
| JP | 2004-205943 | 7/2004 |
| JP | 2005-115261 | 4/2005 |

* cited by examiner

*Primary Examiner* — David Gray
*Assistant Examiner* — Francis Gray
(74) *Attorney, Agent, or Firm* — Rabin & Berdo, PC

(57) ABSTRACT

An image forming apparatus includes a plurality of image forming units forming a visible image by attaching charged developer to an electrostatic latent image, a transfer belt member being transferred the visible image formed by each of the plurality of image forming units, a plurality of tension members tightly stretching the transfer belt member, a primary transfer member transferring the visible image formed by the plurality of image forming units to the transfer belt unit, a secondary transfer member transferring the visible image transferred to the transfer belt member on a recording medium, and a fixing unit fixing the visible image transferred to the recording medium. The plurality of image forming units are disposed in at least two transfer regions formed by segmenting the transfer belt member by the plurality of the tension members.

12 Claims, 14 Drawing Sheets

IMAGE FORMING APPARATUS

BACKGROUND OF THE INVENTION

1. Field of the Invention

The present invention relates to an image forming apparatus having a plurality of image forming units developing and visualizing a latent image formed on a latent image carrier employed for a photocopier, an image recording apparatus, a printer, a facsimile and the like.

2. Description of Related Art

In a related art image forming apparatus printing a multicolor image, plural image forming units developing and visualizing a latent image formed on a latent image carrier are disposed in parallel on a transfer belt tightly stretched by tension members such as a drive roller and a tension roller (e.g., Japanese Un-examined Patent Application Publication No. H07-104609).

Such a related art image forming apparatus cited in the above document, however, has a longer depth thereof due to a parallel disposition of the plurality of image forming units, resulting in an increase in an overall size thereof.

It is an object of the present invention to provide an image forming apparatus capable of reducing a size thereof while reducing occurrences of print quality deterioration due to the reduced size thereof.

BRIEF SUMMARY OF THE INVENTION

According to one aspect of the invention, an image forming apparatus includes: a plurality of image forming units forming a visible image by attaching charged developer to an electrostatic latent image; a transfer belt member being transferred the visible image formed by each of the plurality of image forming units; a plurality of tension members tightly stretching the transfer belt member; a primary transfer member transferring the visible image formed by the plurality of image forming units to the transfer belt unit; a secondary transfer member transferring the visible image transferred to the transfer belt member on a recording medium; and a fixing unit fixing the visible image transferred to the recording medium. The plurality of image forming units are disposed in at least two transfer regions formed by segmenting the transfer belt member by the plurality of the tension members.

Additional features and advantages of the present invention will be more fully apparent from the following detailed description of embodiments, the accompanying drawings and the associated claims.

BRIEF DESCRIPTION OF THE DRAWINGS

A more complete appreciation of the aspects of the invention and many of the attendant advantage thereof will be readily obtained as the same becomes better understood by reference to the following detailed description when considered in connection with the accompanying drawings, wherein.

DETAILED DESCRIPTION OF PREFERRED EMBODIMENTS

Figure 1:
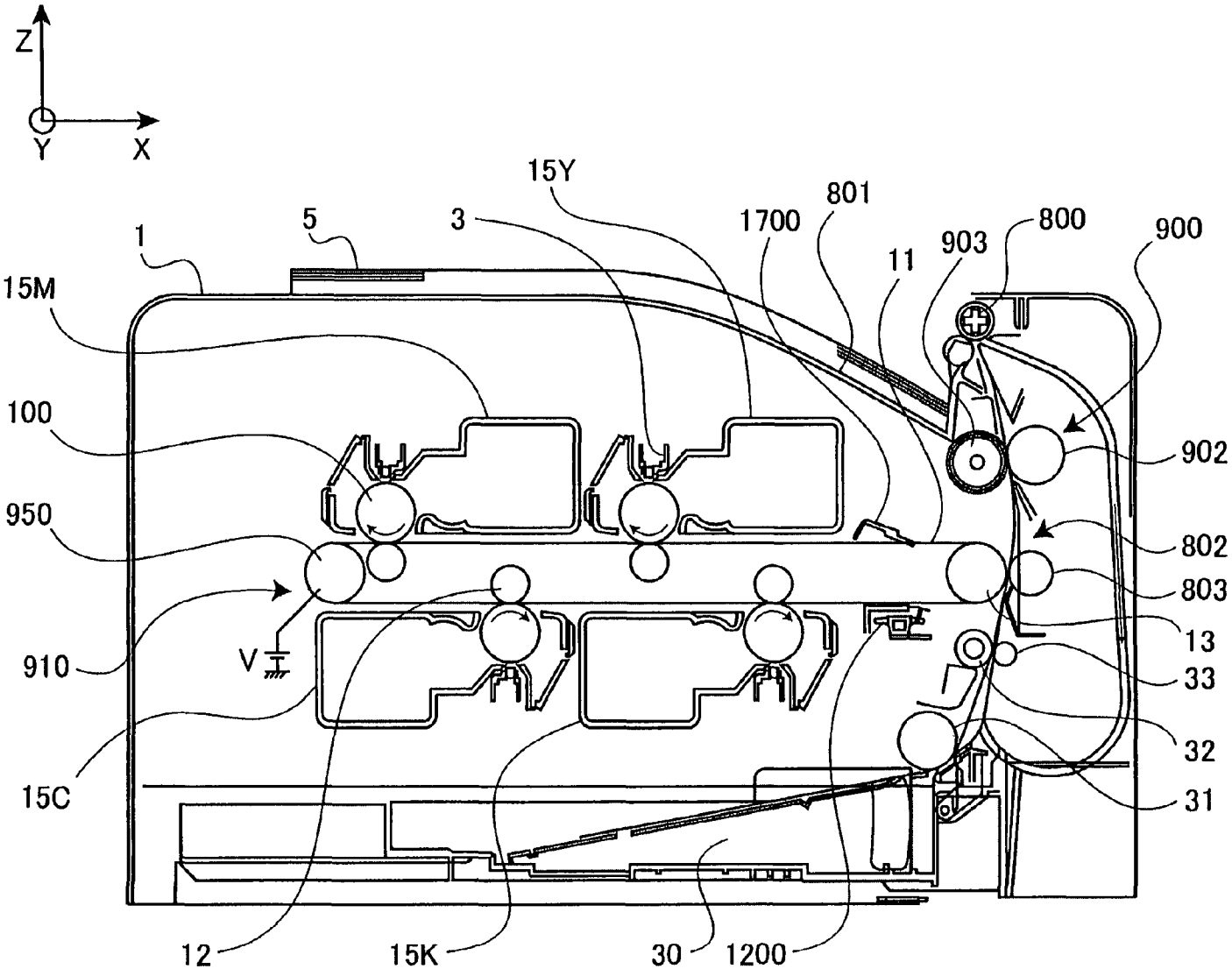
FIG. 1 is a cross-sectional view illustrating an image forming apparatus according to a first embodiment of the present invention.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Reference is now made to the drawings, wherein like reference numerals designate identical or corresponding parts throughout the several views.

First Embodiment

Referring to FIG. 1, an image forming apparatus 1 according to a first embodiment of the present invention is illustrated in a cross-sectional view. An X-axis, a Z-axis and a Y-axis in XYZ coordinates shown in FIG. 1 represent a traveling direction of a transfer belt 11 serving as a transfer medium, a vertical direction with respect to the X-axis, and a direction perpendicular to the X and Z-axes, respectively. The XYZ coordinates designate identical or corresponding axes throughout the several views.

The image forming apparatus 1 includes a recording medium 5, a transfer belt 11 serving as a transfer belt member, a transfer roller 12 serving as a primary transfer member, a driver roller 13 serving as a tension member, image forming units 15Y, 15M, 15C and 15K (color components of yellow, magenta, cyan and black are abbreviated as Y, M, C and K respectively), a sheet cassette 30, a hopping roller 31, a registration roller 32, a pinch roller 33, an ejection roller 800, a recording medium stacking unit 801, a secondary transfer unit 802 including a secondary transfer roller 803, a secondary transfer roller 803, a fixing device 900, a backup roller 902, a heat roller 903, a transfer belt unit 910, a tension roller 950 serving as another tension member, a density sensor 1200, and a cleaning blade 1700.

In the image forming apparatus 1 as illustrated in FIG. 1, the sheet cassette 30 storing the recording medium or media 5 such as a sheet or sheets of paper in an accumulated state therein is attached on an upstream side relative to a conveyance path of the recording medium 5, and the hopping roller 31 picking up the recording medium 5 is disposed above the sheet cassette 30. In the image forming apparatus 1, the pinch roller 33 correcting the recording medium 5 in the diagonal movement with the registration roller 32 is disposed on a downstream side of the hopping roller 31 relative to a sheet conveyance direction of the recording medium 5. The hopping roller 31 and the registration roller 32 are rotated by the power transmitted from a drive source (not shown) through a transmission mechanism such as a gear.

A pair of the drive roller 13 and the tension roller 950 drives the transfer belt 11 tightly stretched thereby. The drive roller 13 is rotated by the power transmitted from a drive source (not shown) through a transmission mechanism such as a gear. The tension roller 950 according to the first embodiment includes a conductive shaft being wound therearound with a conductive resin or rubber, and is applied with voltage of a polarity reverse to the polarity of an electrical potential charged at the toner 4, used for image formation, being charged with an electrical potential from a power source (described later). Here, the voltage to be applied to the tension roller 950 is substantially the same polarity as a voltage applied to the transfer roller 12 when a toner image formed by the image forming unit 15 is transferred to the transfer belt 11.

The image forming apparatus 1 includes the cleaning blade 1700 collecting a remaining residual transfer toner remained on a surface of the transfer belt 11, and the density sensor 1200 detecting a toner density and transmitting toner density information to a print control unit 51 (described later).

The secondary transfer roller 803 in the secondary transfer unit 802 transfers the toner image transferred to the transfer belt 11 by the primary transfer member to the recording medium 5.

The fixing device 900 includes the back up roller 902 and the heat roller 903, and fixes the toner transferred to the recording medium 5 by the secondary transfer unit 802 with pressure and heat. Here, the recording medium 5 having the toner image fixed thereon is conveyed to the recording medium stacking unit 801 by the ejection roller 800.

The four image forming units 15 are disposed in sequence of 15Y, 15M, 15C and 15K from an upper stream side in a print direction in a state of being pressed against the transfer belt 11 as illustrated in FIG. 1.

Figure 2:
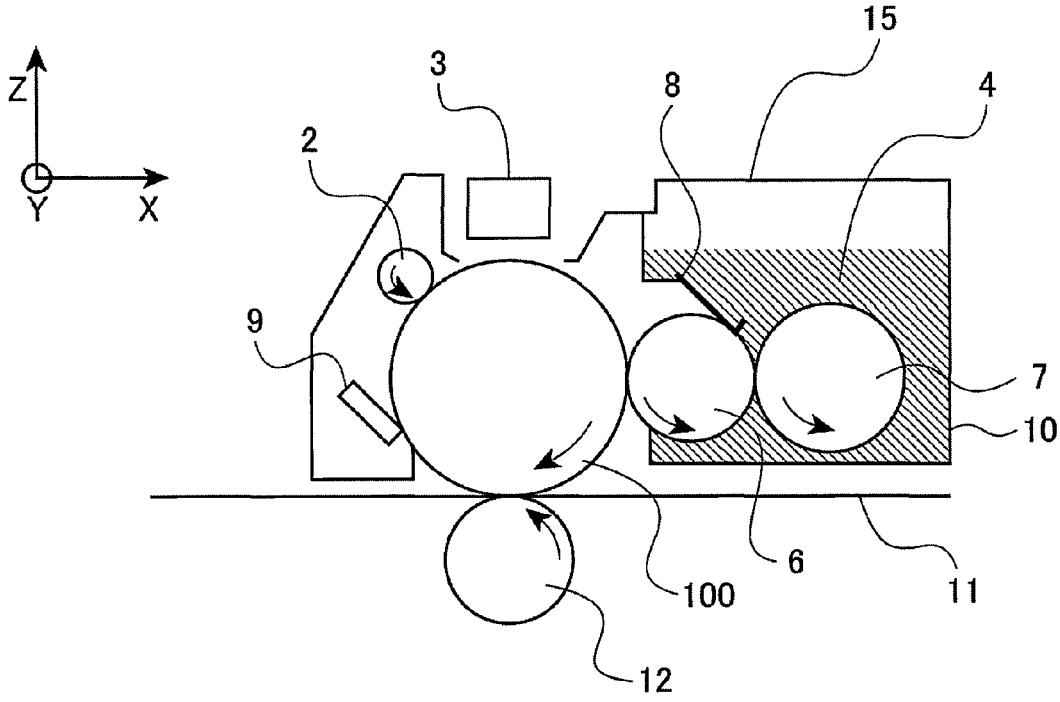
FIG. 2 is a schematic diagram illustrating a transfer roller and an image forming unit included in the image forming apparatus of FIG. 1.

Referring to FIG. 2, each of the image forming units 15Y and 15M disposed above the transfer belt 11 and the transfer roller 12 serving as the primary transfer member are illustrated. Since the image forming units 15Y and 15M are substantially similar to each other except for the toner color, an image forming unit 15 illustrated in FIG. 2 is representative of the image forming units 15Y and 15M. The transfer roller 12 is disposed with respect to each of the image forming units 15.

The image forming unit 15 representing each of the image forming units 15Y and 15M includes a photosensitive drum 100 forming an electrostatic latent image thereon, a charging roller 2 charging a surface of the photosensitive drum 100, a light emitting diode (LED) head 3 including LED elements and the like forming the electrostatic latent image on the surface of the photosensitive drum 10 charged by the charging roller 2, a development roller 6 developing the electrostatic latent image by attaching the toner 4 including toner particles to the electrostatic latent image formed on the surface of the photosensitive drum 100, a toner supply roller 7 supplying the toner 4 to the development roller 6, a development blade 8 evenly adjusting a toner layer supplied from the toner supply roller 7, a cleaning blade 9 removing the toner 4 and the electrostatic latent image remained on the surface of the photosensitive drum 100, and a housing 10 made of resin housing a development device.

The photosensitive drum 100 is rotatable in a direction indicated by an arrow shown in FIG. 2 at predetermined rotation speed. The charging roller 2 is rotatable in a counterclockwise direction as illustrated in FIG. 2 and contacts a surface of the photosensitive drum 100 so as to apply predetermined voltage to the surface thereof. The LED head 3 forms the electrostatic latent image on the surface of the photosensitive drum 100. The development roller 6 supplies the toner 4 to the surface of the photosensitive drum 100 having the electrostatic latent image thereon, thereby developing the electrostatic latent image. The toner supply roller 7 contacts the development roller 6 with certain pressure, and the development blade 8 is disposed to the development roller 6 so as to regulate a thickness of the toner 4 supplied from the toner supply roller 7 at a certain level. The cleaning blade 9 made of an elastic member is disposed to contact the surface of the photosensitive drum 100 with certain pressure using an edge portion thereof.

The fixing roller 12 is disposed below the photosensitive drum 100 through the transfer belt 11 in such a manner to contact the photosensitive drum 100. The fixing roller 12 rotates in a counterclockwise direction as illustrated in FIG. 2 and applies the voltage of the potential reverse to the electrical potential charged at the toner 4. Consequently, the toner image developed on the surface of the photosensitive drum 100 is transferred to the transfer belt 11. The print control unit 51 described later with reference to FIG. 6 controls such a rotation operation, a voltage application operation and the like of each of such elements.

Figure 3:
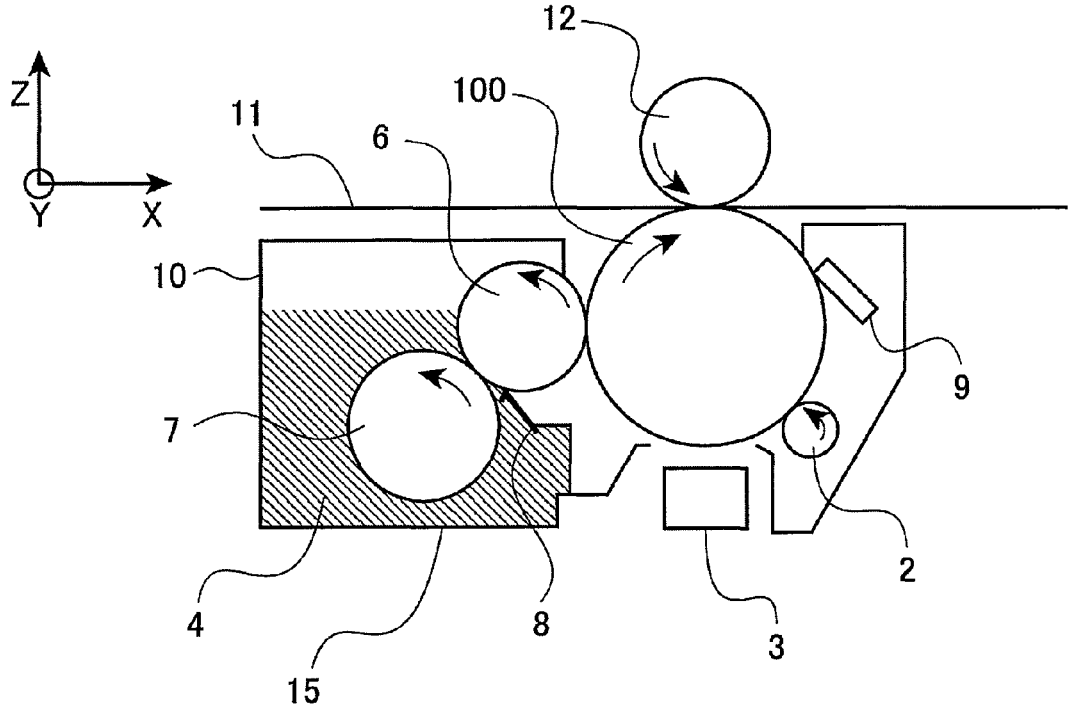
FIG. 3 is another schematic diagram illustrating a transfer roller and an image forming unit included in the image forming apparatus of FIG. 1.

Referring to FIG. 3, each of the image forming units 15C and 15K disposed below the transfer belt 11 and the transfer roller 12 serving as the primary transfer member are illustrated. Since the image forming units 15C and 15K are substantially similar to each other except for the toner color, an image forming unit 15 illustrated in FIG. 3 is representative of the image forming units 15C and 15K. The transfer roller 12 is disposed with respect to each of the image forming units 15.

The image forming unit 15 representing each of the image forming units 15C and 15K illustrated in FIG. 3 is substantially similar to the image forming unit 15 representing the image forming units 15Y and 15M illustrated in FIG. 2 except for positions of the transfer belt 11, the transfer roller 12, and the toner supply roller 7. The transfer belt 11 and the transfer roller 12 in FIG. 3 are disposed at an upper portion in the Z-axis direction compared to those shown in FIG. 2. Since the toner 4 is accumulated in a lower portion in the Z-axis direction by gravity, the toner supply roller 7 is disposed below the development roller 6 in the Z-axis direction. In this way, even where a remaining amount of the toner 4 decreases, a surface of the toner supply roller 7 can convey the toner 4 as much as possible.

Although the development blade 8 regulating the thickness of the toner 4 supplied from the toner supply roller 7 at the certain level is disposed to the development roller 6, the development blade 8 is preferably disposed in a reverse direction relative to the rotation direction of the development roller 6 as illustrated in FIG. 3 so as to reduce a variation in regulation of a toner layer depending on a loading weight of the toner 4. The print control unit 51 described later with reference to FIG. 6 controls a rotation operation, a voltage application operation and the like of each of such elements.

Figure 4:
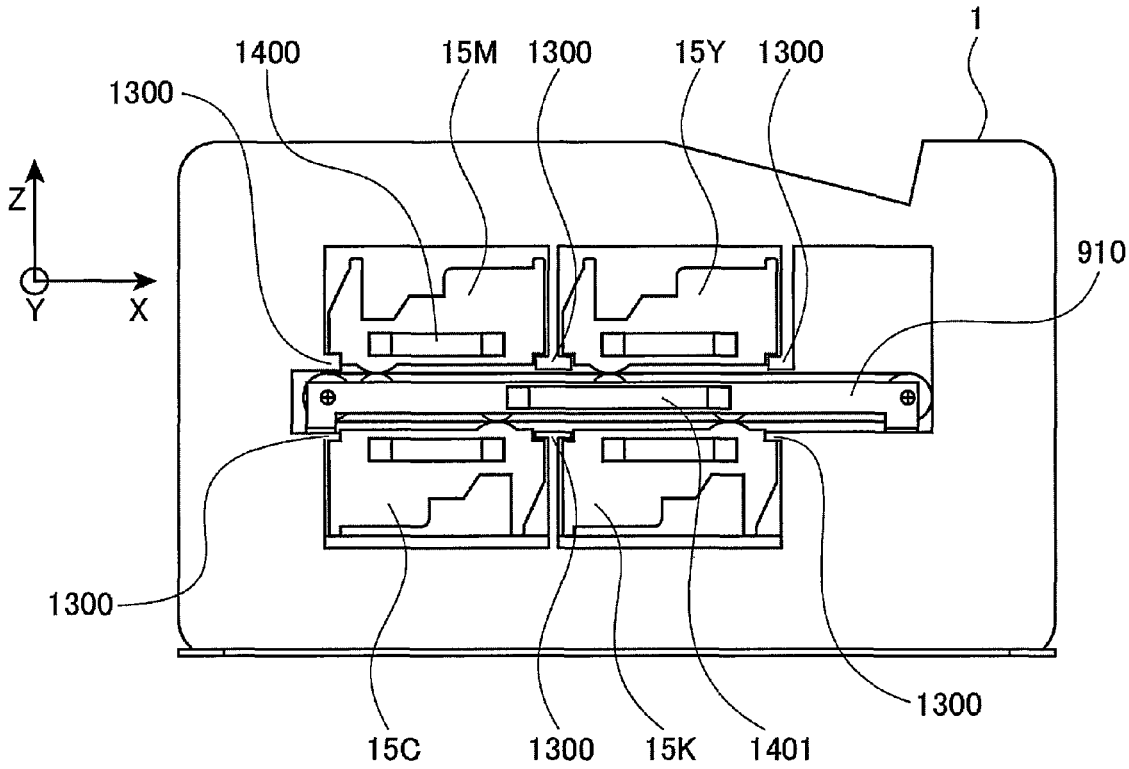
FIG. 4 is a schematic diagram illustrating positions of the image forming units and a transfer belt unit in the image forming apparatus of FIG. 1.

The transfer belt unit 910 includes the image forming units 15Y, 15M, 15C, and 15K, the transfer belt 11, each of the transfer rollers 12, the drive roller 13, the tension roller 950, and the cleaning blade 1700. The transfer belt unit 910 is disposed along a guide unit 1300 in the image forming apparatus 1 as illustrated in FIG. 4.

It should be noted that the first embodiment of the present invention has been described above with four image forming units 15Y, 15M, 15C and 15K, but is not limited thereto. For example, the first embodiment of the present invention may be applied to an image forming apparatus including a plurality of image forming units having the toner colors of red, green, and blue or a plurality of image forming units having the toner colors of gold and silver, etc. in addition to the yellow, magenta, cyan, and black according to the first embodiment. In an image forming procedure, the image forming unit having the toner color of black may be disposed at the last, so that a black image is formed on the recording medium at a short time period when a high frequent usage of the black image is printed. Therefore, the image forming unit having the toner color of black is preferably disposed in the most downstream relative to a print direction.

Figure 5:
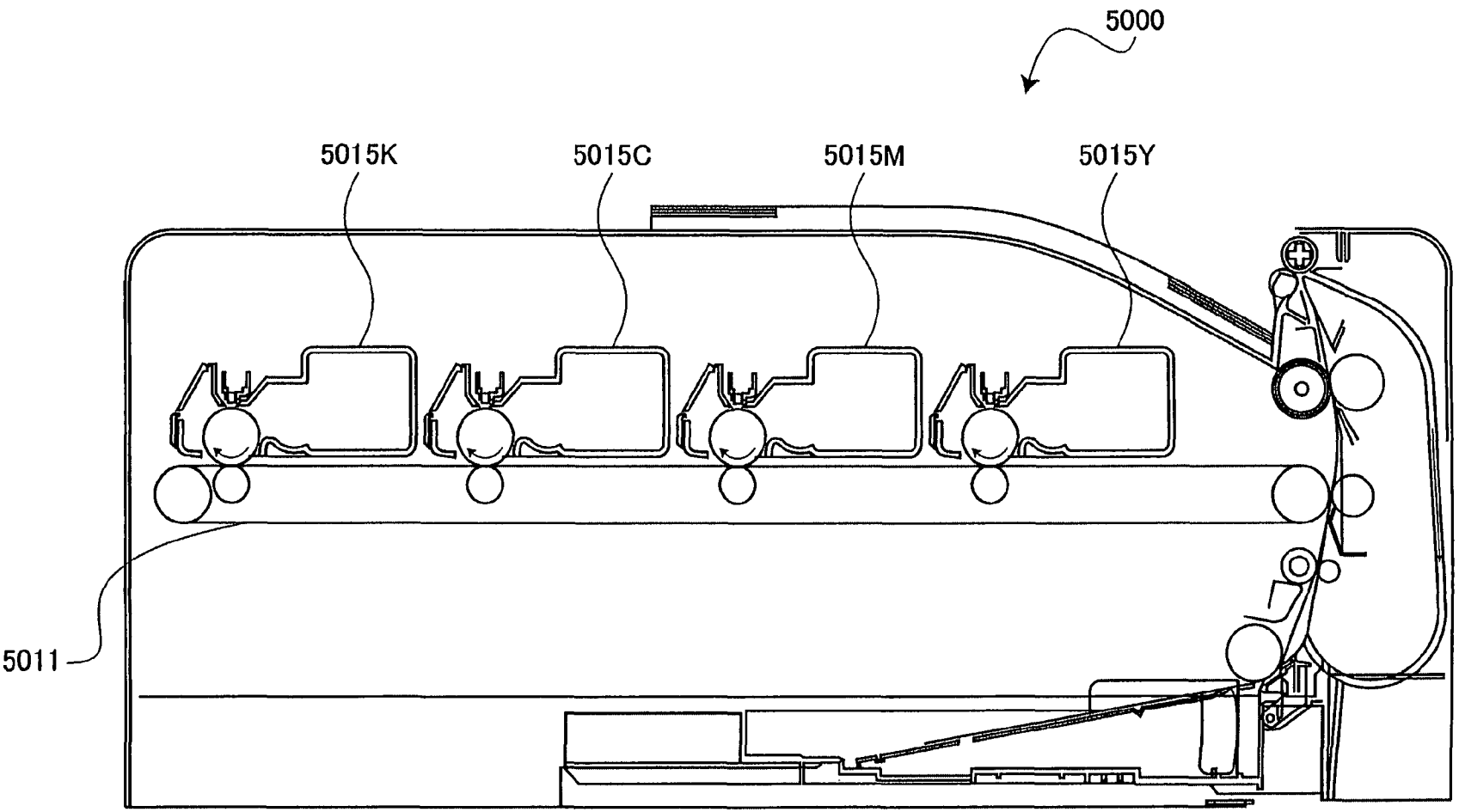
FIG. 5 PRIOR ART
FIG. 5 is a cross-sectional view illustrating a related art image forming apparatus.

Referring to FIG. 5, a conventional image forming apparatus 5000 is illustrated. The image forming apparatus 5000 includes image forming units 5015Y, 5015M, 5015C, and 5015K disposed in parallel at one side of a transfer belt 5011. The image forming apparatus 1 according to the first embodiment of the present invention illustrated in FIG. 1 has a shorter length in the X-axis direction in an amount of two image forming units compared to the conventional image forming apparatus 5000.

Since the image forming apparatus 1 according to the first embodiment has the shorter length in the X-axis direction in the amount of two image forming units compared to the conventional image forming apparatus 5000, a size of the image forming apparatus 1 is reduced.

Figure 6:
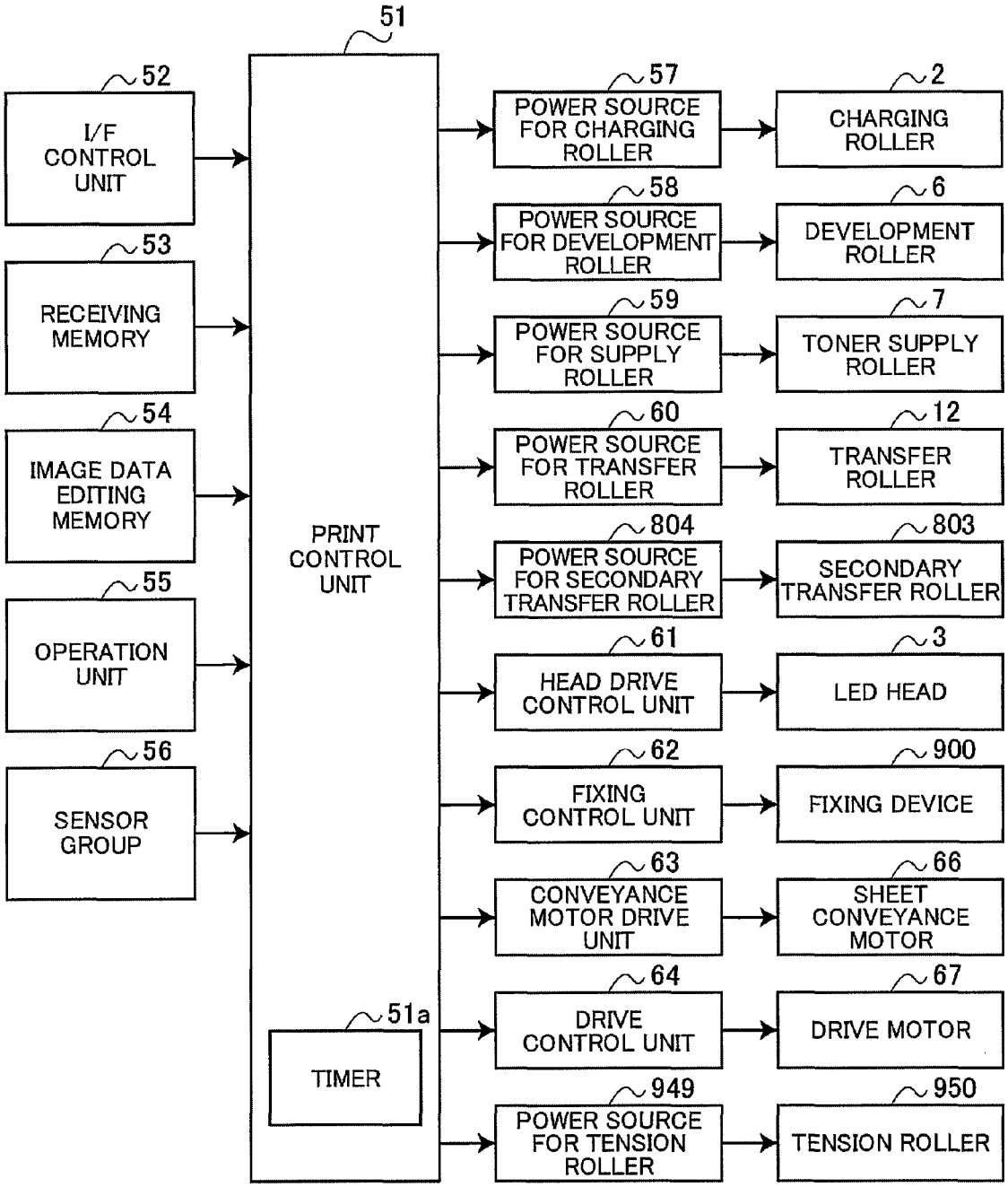
FIG. 6 is a block diagram illustrating a control unit of the image forming apparatus according to the first embodiment.

Referring to FIG. 6, a control unit of the image forming apparatus 1 according to the first embodiment of the present invention is illustrated in a block diagram.

The control unit of the image forming apparatus 1 includes the print control unit 51, an interface (I/F) control unit 52, a receiving memory 53, an image data editing memory 54, an operation unit 55, a sensor group 56, a power source 57 for the charging roller 2, a power source 58 for the development roller 6, a power source 59 for the toner supply roller 7, a power source 60 for the transfer roller 12, a head drive control unit 61, a fixing control unit 62, a conveyance motor drive unit 63, a drive control unit 64, a power source 804 for the secondary transfer roller 803, and a power source 949 for the tension roller 950.

The print control unit 51 includes a microprocessor, a read only memory (ROM), a random access memory (RAM), an input-output port, and a timer 51*a*. The print control unit 51 receives print data and a control command form a higher-level device (not shown) through the I/F control unit 52 and controls a sequence of the image forming apparatus 1 as a whole to execute print operation.

The receiving memory 53 temporality stores the print data input from the higher-level or host device through the I/F control unit 52. The image data editing memory 54 both receives the print data stored in the receiving memory 53 and stores image data formed by editing the print data.

The operation unit 55 includes LED for displaying a state of the image forming apparatus 1 and a switch for inputting an instruction by an operator. The sensor group 56 includes various sensors, for example, a sheet position sensor, a temperature-humidity sensor, and a density sensor, for monitoring an operation state of the image forming apparatus 1.

The power source 57 for the charging roller 2 applies the voltage to the charging roller 2. The power source 58 for the development roller 6 applies the voltage to the development roller 6. The power source 59 for the toner supply roller 7 applies the voltage to the toner supply roller 7. The power source 60 for the transfer roller and the power source 804 for the secondary transfer roller apply the voltage to the transfer roller 12 serving as the transfer member and the secondary transfer roller 803 respectively.

The head drive control unit 61 transmits the image data stored in the image data editing memory 54 to the LED head 3 and drives the LED head 3.

The fixing control unit 62 provides an instruction to apply predetermined voltage to the heat roller 903 included in the fixing device 900 from a power source (not shown) so as to fix the toner image transferred to the recording medium 5. The fixing device 900 includes the heat roller 903 fusing the toner 4 of the toner image transferred to the recording medium 5 and a temperature sensor detecting temperature. The fixing control unit 62 controls the heat roller 903 such that the temperature of the heat roller 903 is at a certain level based on a sensor output from the temperature sensor.

The conveyance motor drive unit 63 controls rotation of a sheet conveyance motor 66 for conveying the recording medium 5. The conveyance motor drive unit 63 conveys the recording medium 5 at a predetermined timing and halts the conveyance of the recording medium 5 based an instruction of the print control unit 51. The drive control unit 64 controls rotation of a drive roller 67 involving the image forming units 15.

The power source 949 for the tension roller 950 applies predetermined voltage to the tension roller 950 in the course of the print operation. The voltage to be applied to the tension roller 950 has the polarity reverse to the polarity of the electrical potential charged at the toner 4.

Now, the operation of the image forming apparatus 1 is described. The print control unit 51 receives the print data from the higher-level or host device (not shown) through the I/F control unit 52 and temporarily stores the print data in the receiving memory 53. Subsequently, the print control unit 51 forms the image data by editing the print data stored. The formed image data are stored in the image data editing memory 54.

The print control unit 51 provides an instruction to the conveyance motor drive unit 63 to drive the sheet conveyance motor 66. The hopping roller 31 begins to rotate by the driving of the sheet conveyance motor 66 and separates a plurality of recording media 5 stored in the sheet cassette 30 in the accumulated state one by one from the top, so that each of the recording media 5 is separately fed into the sheet conveyance path. The diagonal movement of the recording medium 5 is corrected in the course of passing the registration roller 32, and the recording medium 5 is further conveyed to the secondary transfer unit 802. The print control unit 51 provides an instruction to the drive control unit 64 to drive the drive motor 66. The drive motor 66 begins to drive based on the instruction of the drive control unit 64, and drive power of the drive motor 66 is transmitted to each of the rollers, so that each of the rollers begins to rotate.

Simultaneously, the image forming unit 15Y begins to form a yellow image. The print control unit 51 supplies instructions to the power sources 57, 58, 59, and 949 to apply the voltage to the charging roller 2, development roller 6, the toner supply roller 7, and the tension roller 950 respectively. The charging roller 2 with the predetermined voltage applied thereto charges the surface of the photosensitive drum 100 to the certain level. Subsequently, the print control unit 51 provides the instruction to the hard drive control unit 61 based on the image data stored in the image data editing memory 54. Upon receiving the instruction, the head drive control unit 61 drives the LED head 3, so that the LED head 3 exposes the surface of the photosensitive drum 100, thereby forming the electrostatic latent image on the surface thereof.

The development roller 6 supplied with the toner 4 from the toner supply roller 7 attaches the toner 4 to the electrostatic latent image formed on the surface of the photosensitive drum 100, so that the electrostatic latent image is developed and the toner image of yellow is formed. The photosensitive drum 100 having the yellow toner image on the surface thereof continues to rotate, and the print control unit 51 provides the instruction to the power source 60 to apply the predetermined voltage to the transfer roller 12 when the surface of the photosensitive drum 100 having the yellow toner image becomes closer to the surface of the transfer belt 11. By application of the predetermined voltage to the transfer roller 12, the toner image on the surface of the photosensitive drum 100 is transferred to the transfer belt 11. The cleaning blade 9 scrapes the toner 4 being not transferred to the transfer belt 11 from the surface of the photosensitive drum 100, and the charging roller 2 uniformly charges the surface of the photosensitive drum 100 again. Such image forming processes are sequentially performed in the image forming units 15Y, 15M, 15C, and 15K. Each of the toner images formed by respective image forming units 15Y, 15M, 15C, and 15K is sequentially transferred to the transfer belt 11, thereby overlaying the toner images.

When each color of the toner images is formed on the transfer belt 11, the print control unit 51 provides an instruction to the power source 804 to apply the voltage to the secondary transfer roller 803. When the recording medium 5 reaches the secondary transfer roller 803 being applied with the voltage, each of the toner images on the transfer belt 11 is transferred on the recording medium 5. Next, the print control unit 51 provides an instruction to the fixing control unit 62 to heat the heat roller 903 included in the fixing device 900. The toner image transferred on the recording medium 5 is fixed by heat and pressure applied by the heat roller 903 and the backup roller 902. The recording medium 5 having the toner imaged fixed thereon is ejected on the recording medium stacking unit 801 disposed outside the image forming apparatus 1. Therefore, a multi-color image is formed on the recording medium 5 by the process above.

In a related art image forming apparatus, on the other hand, a tension roller is not applied with the voltage. In this regard, an upper portion of the toner (i.e., the toner positioned in a relatively longer distance from a transfer belt) is dropped from a transfer belt due to the gravity, causing deterioration of the image.

Figure 7:
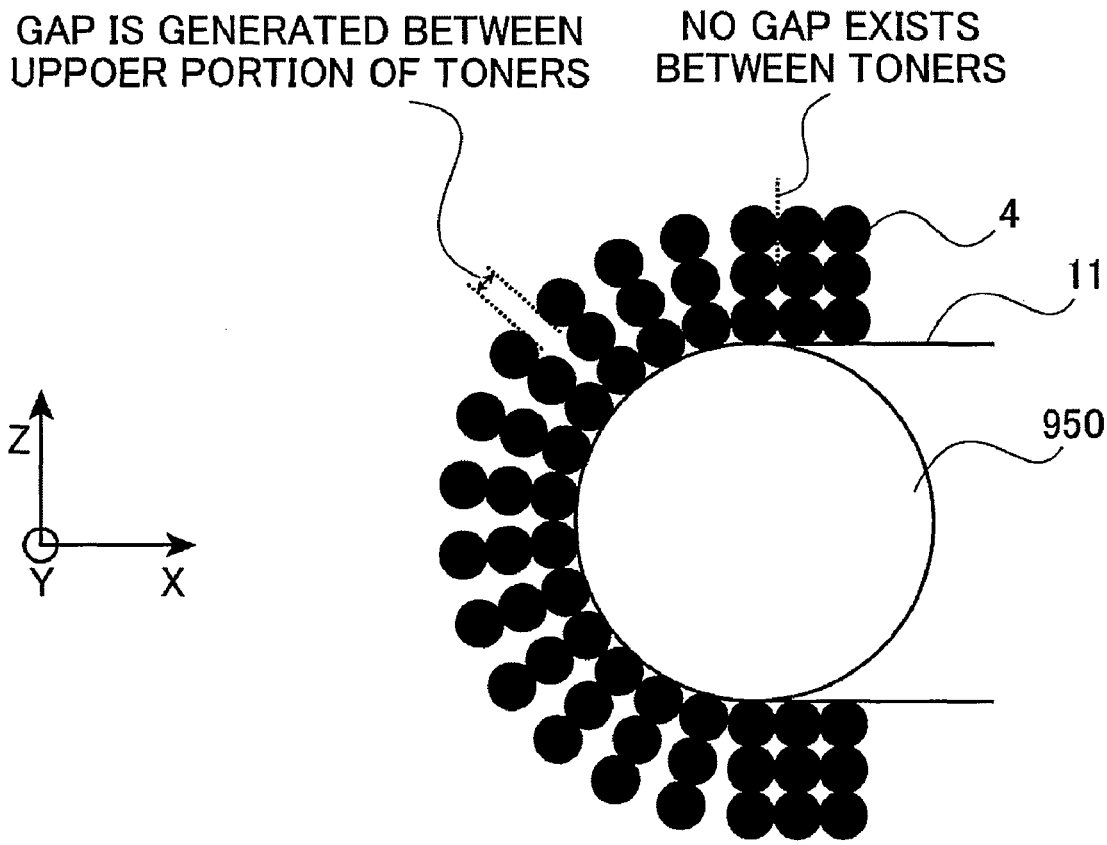
FIG. 7 is a schematic diagram illustrating toner in a curve portion of a transfer belt.

The toner images of yellow and magenta formed on the transfer belt 11 tend to drop from the transfer belt 11 due to the gravity exerted at a curve portion of the transfer belt 11 curved by the tension roller 950 tightly stretching the transfer belt 11. In other words, the toner particles of the toner 4 forming the image on the transfer belt 11 increase a distance therebetween at the curve portion of the transfer belt 11 as illustrated in FIG. 7, causing a decrease in an interaction of the toner particles adjacent to each other. In other words, a surface layer of the transfer belt 11 decreases power to hold the toner 4 thereon by losing the Van der Waals force generated by attraction of the toner particles, causing deterioration of the toner image by the gravity.

According to the present invention, the voltage having the polarity reverse to the polarity of the electrical potential charged at the toner 4 is applied to the tension roller 950 so as to attract the toner 4 to a side of the transfer belt 11, thereby holding the toner 4 on the transfer belt 11 by reducing (if not eliminating) an occurrence of dropping the toner 4 from the transfer belt 11.

After the toner images of yellow and magenta are formed by the image forming units 15Y and 15M respectively, the toner images of cyan and black are sequentially transferred on the transfer belt 11 in the course of passing through the image forming units 15C and 15K having the toner colors of cyan and black respectively. The toner images overlaid on the transfer belt 11 are transferred on the recording medium 6 in the secondary transfer unit 802 by the voltage applied to the secondary transfer roller 803.

Figure 8:
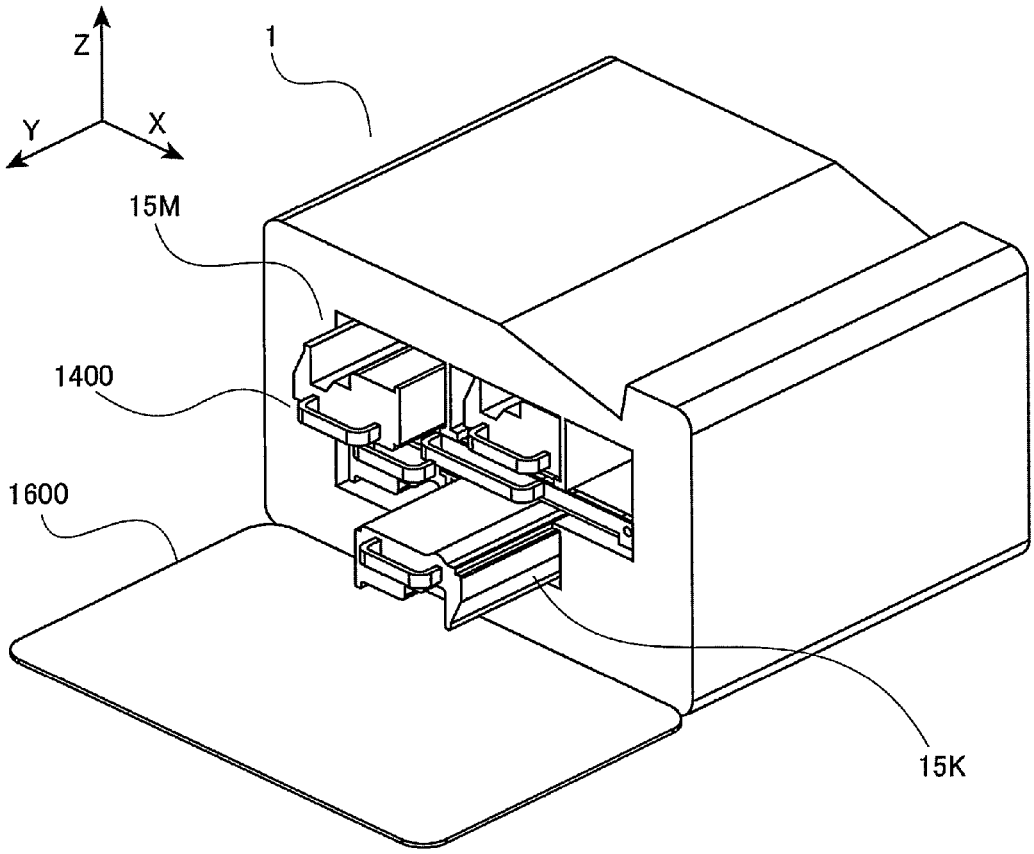
FIG. 8 is a schematic diagram illustrating a replacement method for the image forming unit.

When at least one of the image forming units 15Y, 15M, 15C, and 15K is replaced, a cover 1600 is opened for pulling out the image forming unit 15 along a portion extended toward inside of the image forming apparatus 1 in a rail shape with the guide unit 1300 rubbing the outside of the image forming unit 15 as illustrated in FIG. 8. Here, the LED head 3 is separated from the image forming unit 15 by a separation mechanism (not shown).

Figure 9:
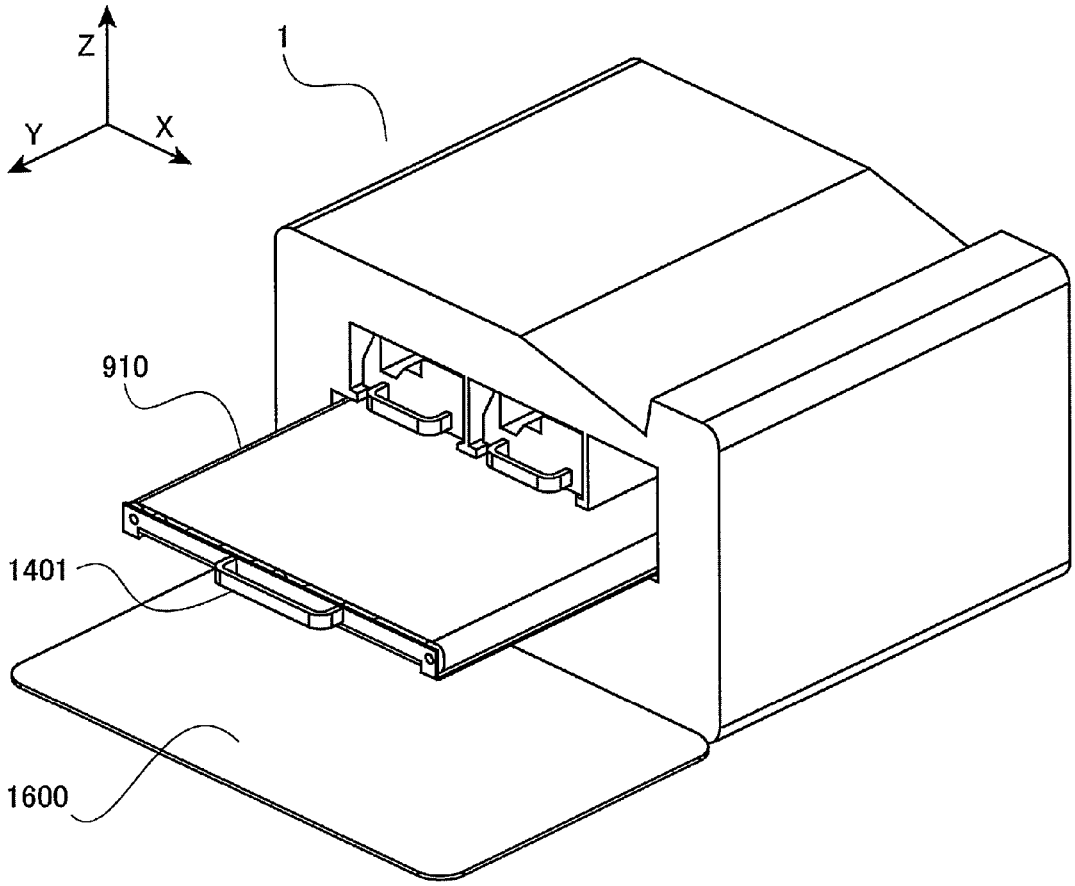
FIG. 9 is a schematic diagram illustrating a replacement method for the transfer belt.

When transfer belt unit 910 is replaced, the cover 1600 is opened for pulling out the transfer belt unit 910 using a handle 1401 along a portion extended toward inside of the image forming apparatus 1 in a rail shape with the guide unit 1300 rubbing the outside of the image forming unit 15 as illustrated in FIG. 9.

When the image forming unit 15 is pulled out, a handle 1400 of the image forming unit 15 is held and pulled out in the Y-axis direction. For example, when the image forming units 15C and 15K are withdrawn and inserted in the Z-axis direction, the image forming units 15Y and 15M and the transfer unit 910 need to be removed. When the image forming units 15M and 15C are withdrawn and inserted in the X-axis direction, the image forming units 15Y and 15K need to be removed. Therefore, the image forming units 15Y, 15M, 15C, and 15K are preferably withdrawn and inserted in the Y-axis direction with ease.

According to the first embodiment described above, the image forming apparatus 1 has the shorter length in the X-axis direction in the amount of two image forming units compared to the related art image forming apparatus, thereby reducing the size thereof. Moreover, the tension roller 950 of the first embodiment is employed, so that the toner 4 remains held on the surface layer of the transfer belt 11 even when the interaction of the toner particles adjacent to each other is decreased in the curve portion of the transfer roller 11, thereby reducing (if not eliminating) the deterioration of the toner image.

Second Embodiment

Figure 10:
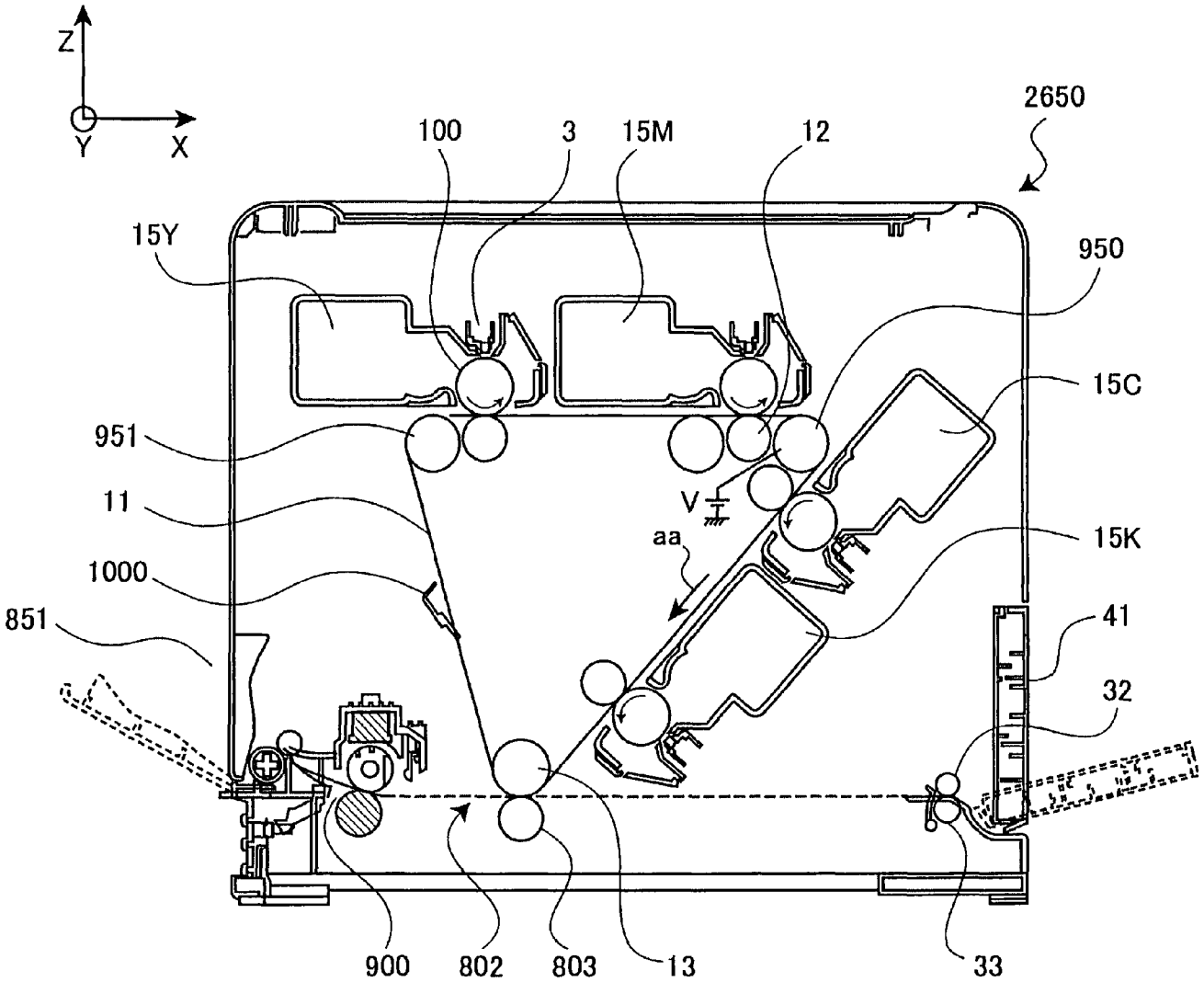
FIG. 10 is a cross-sectional view illustrating an image forming apparatus according to a second embodiment of the present invention.

Referring to FIG. 10, an image forming apparatus 2650 according to a second embodiment of the present invention is illustrated. An element and a configuration of the image forming apparatus 2650 similar to those of the image forming apparatus 1 of the first embodiment described above will be given the same reference numerals as the image forming apparatus 1 of the first embodiment and description thereof will be omitted.

In the image forming apparatus 2650 according to the second embodiment, a transfer belt 11 is tightly stretched by three tension members, a tension roller 951, the tension roller 950 applied with the voltage as described in the first embodiment, and the drive roller 13, and the image forming units 15M, 15Y, 15C, and 15K are disposed in two transfer regions being not arranged most adjacent to the fixing device 900 among three transfer regions formed by the three tension members as illustrated in FIG. 10.

The image forming apparatus 2650 includes a cleaning blade 1000, scraping the toner 4 remained on the transfer belt 11, disposed in the transfer region most adjacent to the fixing device 900. The other configurations of the image forming apparatus 2650 are substantially similar to those of the image forming apparatus 1 of the first embodiment. Since the print operation of the second embodiment is also substantially similar to that of the first embodiment, description thereof will be omitted while an element, a configuration and an operation of the image forming apparatus 2650 that differ from those of the above first embodiment will be described.

Figure 11:
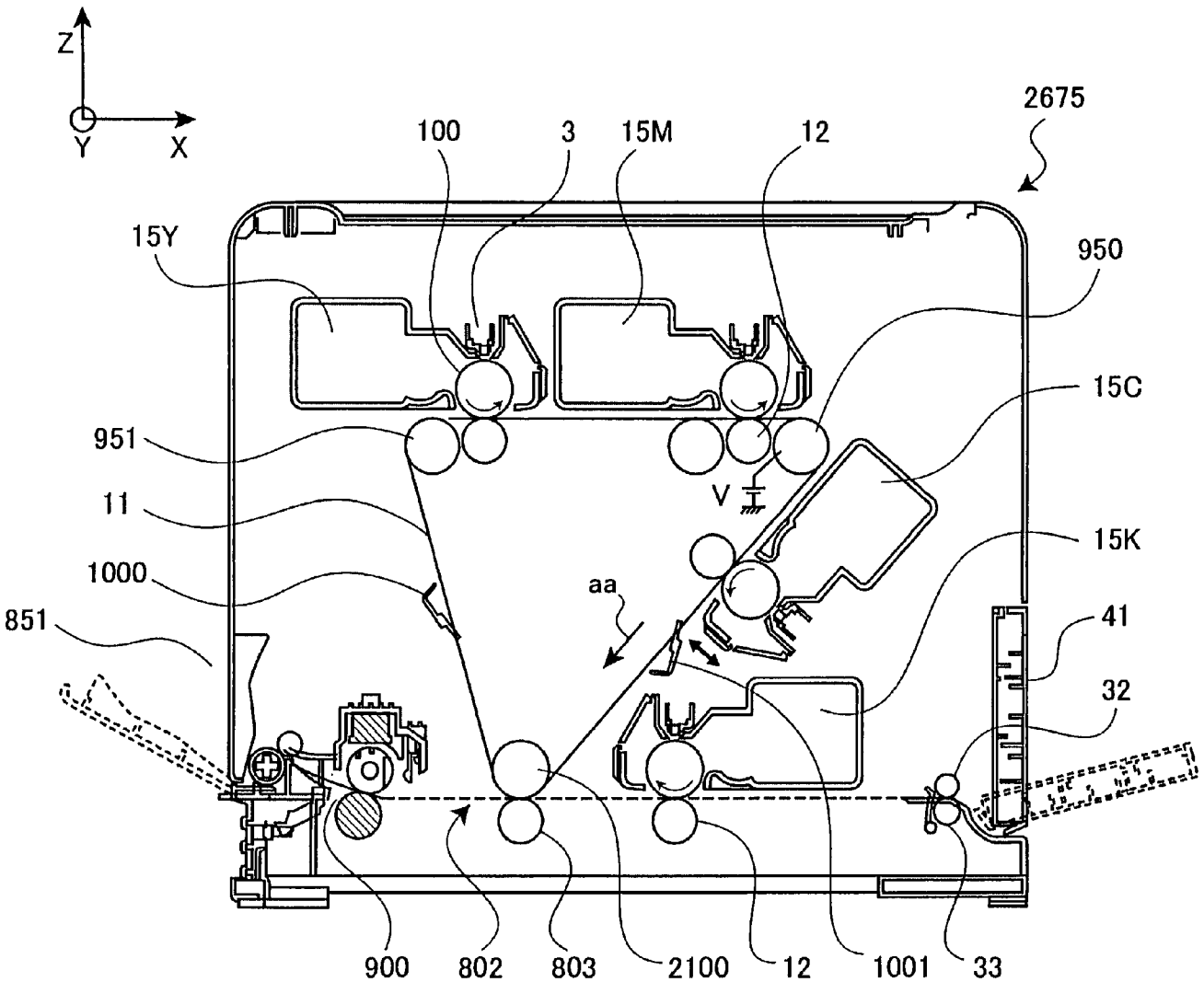
FIG. 11 is a cross-sectional view illustrating an image forming apparatus according to a third embodiment of the present invention.

The print data are received, and the cleaning blade 1000 scrapes the toner 4 remained on the transfer belt 11 beginning to rotate in a direction aa indicated by an arrow shown in FIG. 11 by an instruction of the print control unit 51. Here, the toner image is not transferred on the transfer belt 11 although the surface of the transfer belt 11 cleaned by the cleaning blade 1000 passes a portion curved by the tension roller 951.

The toner images of yellow and magenta are formed when the surface of the transfer belt 11 cleaned by the cleaning blade 1000 passes through the image forming units 15Y and 15M respectively. According to the second embodiment, the voltage having the polarity reverse to the polarity of the electrical potential charged at the toner 4 is applied in a position of the tension roller 950, that is, a position in which the surface of the transfer belt 11 having the toner images transferred thereon by the image forming units 15Y and 15M passes the curve portion.

The toner images are sequentially formed by the image forming units 15C and 15K on the surface of the transfer belt 11 having passed the curve portion. When the transfer belt 11 having the toner images formed and transferred by all of the image forming units reaches the secondary transfer unit 802, the toner images on the transfer belt 11 are transferred on the recording medium 5. Substantially, the recording medium 5 having the toner images transferred thereon is conveyed to the fixing device 900. The toner images on the recording medium 5 are fixed by the fixing device 900, and the recording medium 5 is stacked on the stacking tray 851.

In a case where such a print operation as described above is repeated, inside temperature of the image forming apparatus 2650 increases due to the heat generated from the fixing device 900. Such an increase of the inside temperature is particularly notable in a portion near the fixing device 900. Moreover, in a case where a size of an image forming apparatus is smaller, such an increase of the inside temperature of the apparatus is more notable compared to an image forming apparatus of a general size.

In a case where such an increase of the temperature is occurred in an image forming apparatus, toner inside an image forming unit softens. Consequently, toner particles of the toner slightly fuse one another, resulting in deterioration of print quality.

In the image forming apparatus 2650 according to the second embodiment of the present invention, the image forming unit is not disposed to the surface of the transfer belt in a position most adjacent to the fixing device 900. Therefore, each of the image forming units can reduce an occurrence of being influenced by the heat generated by the fixing device 900 in the course of a successive print operation, thereby reducing (if not eliminating) the deterioration of the print image.

According to the second embodiment of the present invention described above, the image forming apparatus 2650 reducing the influence to the image forming units 15 by the heat generated by the fixing device 900 can be provided while the size of the image forming apparatus 2650 can be reduced.

Third Embodiment

Referring to FIG. 11, an image forming apparatus 2675 according to a third embodiment of the present invention is illustrated. The image forming apparatus 2675 according to the third embodiment is substantially similar to the image forming apparatus 2650 according to the second embodiment above, and an element and a configuration of the image forming apparatus 2675 similar to those of the image forming apparatus 2650 of the second embodiment will be given the same reference numerals and description thereof will be omitted. However, the image forming unit 15K having the toner color of black is disposed at an upstream side relative to the sheet conveyance path of the recording medium 5 as illustrated in FIG. 11. A drive roller 2100 forms a curve portion at a downstream side of the image forming unit 15C relative to the print direction, and is applied with the voltage having the same polarity as the electrical potential charged at the toner 4, included in the image forming unit 15K, being charged with the electrical potential. Moreover, the image forming apparatus 2675 includes a cleaning blade 1001 scraping the toner 4. The cleaning blade 1001 is disposed at the downstream side of the image forming unit 15C relative to the print direction.

The other configurations of the image forming apparatus 2675 are substantially similar to those of the image forming apparatus 2650 of the second embodiment. Since the print operation of the third embodiment is also the substantially similar to that of the second embodiment, description thereof will be omitted while an element, a configuration and an operation of the image forming apparatus 2675 that differ from those of the above second embodiment will be described.

The drive roller 2100 includes a conductive shaft wound semiconductive resin or rubber and the like therearound and is applied with the electrical potential of same polarity as the electrical potential charged at the toner 4, included in the image forming unit 15K, being charged with the electrical potential from a power source 1100 (described later) for the driver roller 2100.

The cleaning blade 100 is disposed in such a manner to be movable to contact and separate from the transfer belt 11 by an actuator (not shown).

The toner 4 used for the third embodiment is charged to a negative potential by triboelectric charge.

Figure 12:
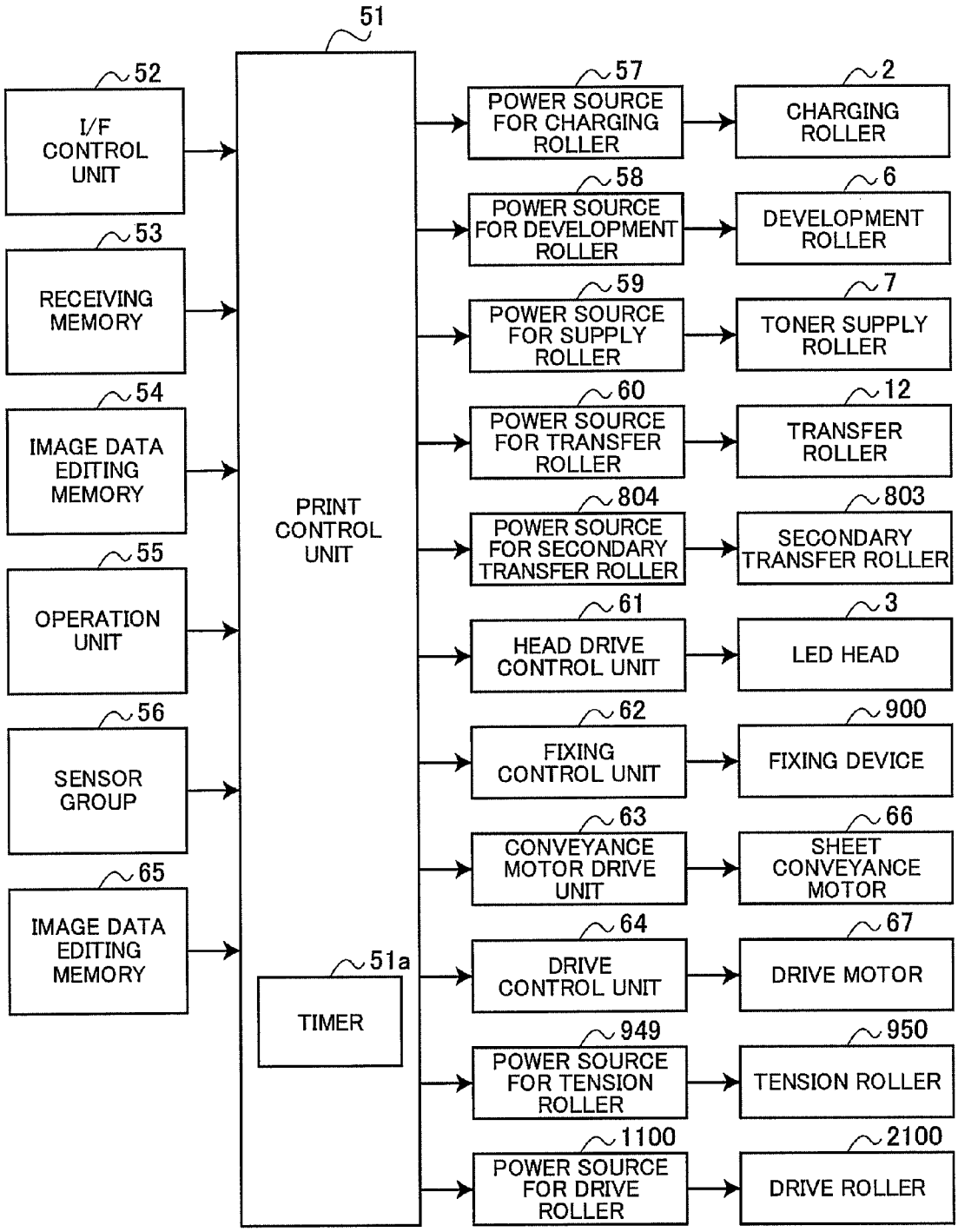
FIG. 12 is a block diagram illustrating a control unit of the image forming apparatus according to the third embodiment of the present invention.

Referring to FIG. 12, a control unit of the image forming apparatus 2675 according to the third embodiment is illustrated in a block diagram. The control unit of the image forming apparatus 2675 includes a second image data editing memory 65 and the power source 1100 for the driver roller in addition to the control unit of the image forming apparatus 1 according to the first embodiment described above with reference to FIG. 6. An element and a configuration illustrated in FIG. 12 similar to those of FIG. 6 will be given the same reference numerals and description thereof will be omitted.

Although the second image data editing memory 65 is substantially the same as the first image data editing memory 54, the second image data editing memory 65 serving as a memory is used when the toner image of black is formed on the recording medium 5.

The power source 1100 applies a predetermined voltage to the drive roller 2100 based on an instruction of the print control unit 51.

Now, a description is given of formation of a multi-color image on the recording medium 5 by the image forming apparatus 2675. After receiving the print data, the print control unit 51 forms the image data by editing the print data, involving the black toner, stored in the receiving memory 53. The formed image data are stored in the image data editing memory 65. Subsequently, the print control unit 51 provides an instruction to the head drive unit 61 based on the image data stored in the image editing memory 65. Upon receiving the instruction, the head drive unit 61 drives the LED head 3 disposed inside the image forming unit 15K, and the LED head 3 exposes the surface of the photosensitive drum 100, thereby forming the electrostatic latent image on the surface thereof.

The development roller 6 supplied with the toner 4 from the toner supply roller 7 attaches the toner 4 to the electrostatic latent image formed on the surface of the photosensitive drum 100, so that the electrostatic latent image is developed and the toner image of black is formed. The photosensitive drum 100 having the black toner image on the surface thereof continues to rotate, and the print control unit 51 provides the instruction to the power source 60 to apply the predetermined voltage to the transfer roller 12 when the surface of the photosensitive drum 100 having the black toner image becomes closer to the surface of the recording medium 5. By application of the predetermined voltage to the transfer roller 12, the toner image on the surface of the photosensitive drum 100 is transferred to the recording medium 5.

On the other hand, each of the image forming units 15Y, 15M, and 15C begins to form the toner image, and each of the toner images formed by the image forming units 15Y, 15M, and 15C is transferred on the transfer belt 11.

When the surface of the transfer belt 11 having thereon the transferred toner images formed by the image forming units 15Y, 15M, and 15C and the recording medium 5 having the black toner image transferred thereon reach the secondary transfer roller 803, the toner images on the surface of the transfer belt 11 are transferred on the recording medium 5, thereby forming a multi-color toner image on the recording medium 5. When the surface of the transfer belt 11 having thereon the transferred toner images formed by the image forming units 15Y, 15M, and 15C reaches the secondary transfer roller 803, the cleaning blade 1001 is moved by the actuator to a position in which the cleaning blade 1001 does not contact the transfer belt 11.

The toner image transferred on the recording medium 5 is fixed by the fixing operation that is substantially the same as the operation described above in the first and second embodiments.

Now, a description is given of formation of the image having only the black toner image on the recording medium 5. In such a case, the operation of the image forming unit 15K is substantially the same as that of the multi-color image formation described above. Here, the toner images involving the image forming units 15Y, 15M, and 15C are not formed on the transfer belt 11. The surface of the transfer belt 11 is cleaned by the cleaning belt 1001 being moved by the actuator to a potion in which the cleaning belt 1001 contacts the transfer belt 11, the cleaned surface of the transfer belt 11 contacts the recording medium 5 by the secondary transfer roller 803.

Here, the print control unit 51 provides an instruction to the power source 1100 to apply the polarity reverse to the polarity of the electrical potential charged at the black toner to the drive roller 2100.

The toner image of black transferred on the recording medium 5 is fixed by the fixing operation that is substantially the same as the operation described above in the first and second embodiments.

In a case where the print operation is repeated, reverse charge toner is generated in each color of the toner 4 included in the image forming units 15Y, 15M, 15C, and 15K due to deterioration or charge shortage. Such a repeat of the print operation causes the toner 4 inside the image forming units 15Y, 15M, 15C, and 15K to continue to be damaged mechanically resulting in deterioration of a charge characteristic and in being charged to a reverse potential (reverse potential toner) in a contact area between the development blade 8 and the development roller 6 or in a contact area between the development roller 6 and the toner supply roller 7 in the process of image formation. Such reverse potential toner is moved on the photosensitive drum 100 regardless of the electrostatic latent image formed thereon and is also moved on the transfer belt 11 by the Van der Waals force. Therefore, in a case where the cleaning blade 1001 is not disposed, the reverse charge toner exists on the transfer belt 11 regardless of the toner image formed thereon and is moved on the recording medium 5 in the secondary transfer unit 802, resulting in deterioration of the print quality.

According to the third embodiment, where the image having only the black toner image is formed, the cleaning blade 1001 scrapes the reverse charge toner existed on the transfer belt by contacting the transfer belt 11 so as to reduce (if not prevent) an occurrence of moving the reverse charge toner on the transfer belt 11 to the recording medium 5. However, in a case where the cleaning blade 1001 constantly contacts the transfer belt 11, the toner forming the multi-color image excluding the black color is scraped. Therefore, a position of the cleaning blade 1001 is adjusted by the actuator in such a manner not to contact the transfer belt 11 when the multi-color image is formed.

Moreover, the reverse charge toner has a positive polarity according to the third embodiment. Such the reverse charge toner might be moved to the recording medium 5 in the secondary transfer unit 802 as described above. Therefore, the image forming apparatus 2675 according to the third embodiment includes the drive roller 2100 being applied with the negative voltage attracting the reverse charge toner to a side of the transfer belt 11 through the transfer belt 11 in the secondary transfer unit 802. Consequently, the reverse charge toner, being charged to the positive, developed on the recording medium 5 in the course of the image formation with the black toner is moved to the side of the transfer belt 11 by the negative voltage applied to the drive roller 2100 while the toner serving as normal charge toner forming the image remains held on the recording medium 5. In other words, the reverse charge toner attached to the recording medium 5 in the image forming unit 15 can be collected by the secondary transfer unit 802.

Therefore, according to the third embodiment described above, where the image having only the black toner image is formed, the image forming apparatus 2675 can reduce (if not prevent) a mixture of the toner used in another image forming unit and can reduce (if not prevent) deterioration of the print quality caused by the reverse charge toner in addition to the advantage of the second embodiment.

Fourth Embodiment

Figure 13:
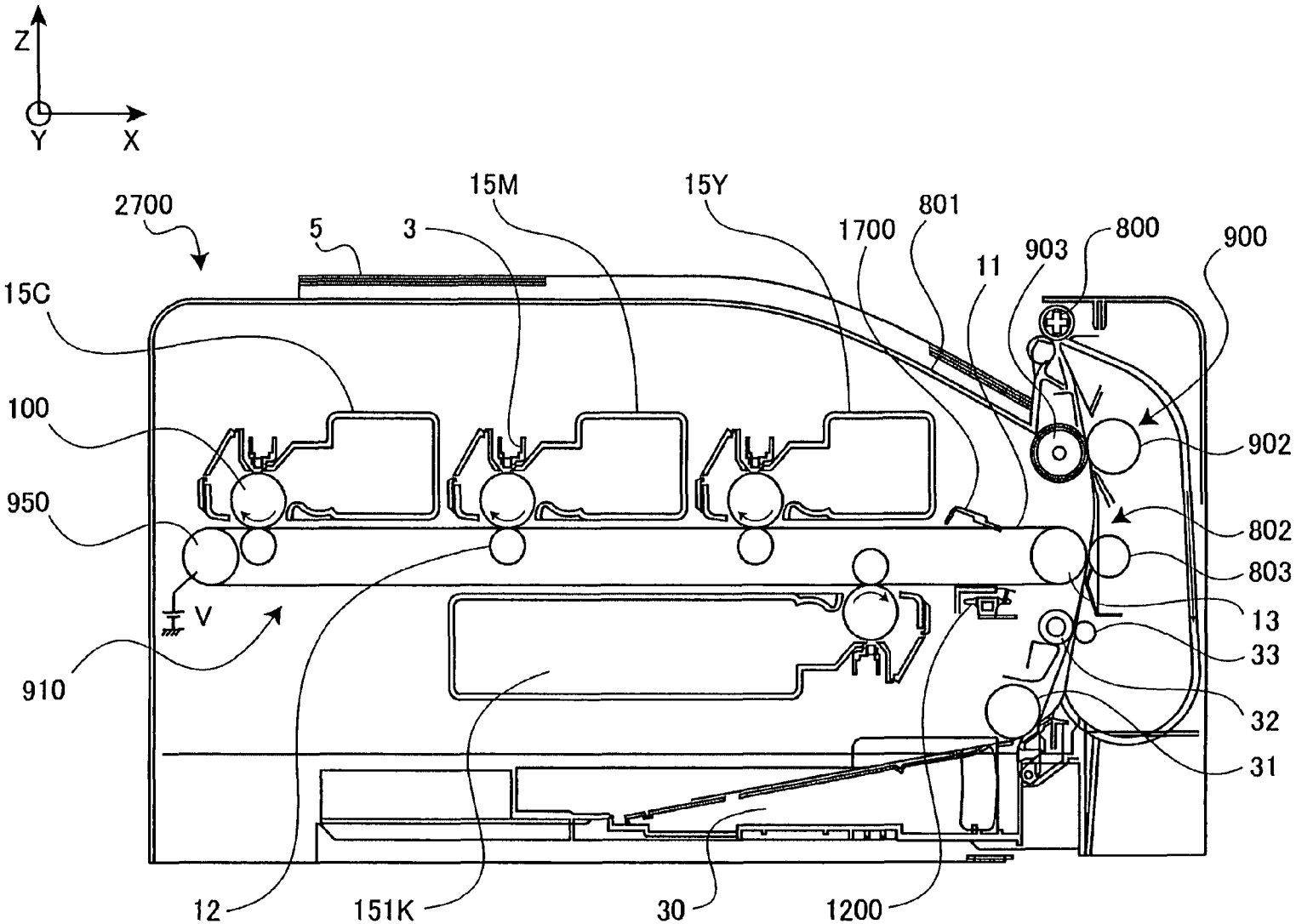
FIG. 13 is a cross-sectional view illustrating an image forming apparatus according to a fourth embodiment of the present invention.

Referring to FIG. 13, an image forming apparatus 2700 according to a fourth embodiment of the present invention is illustrated in a block diagram. An element and a configuration of the image forming apparatus 2700 similar to those of the image forming apparatus 1 of the first embodiment described above will be given the same reference numerals as the image forming apparatus 1 of the first embodiment and description thereof will be omitted. As illustrated in FIG. 13, the image forming apparatus 2700 according to the fourth embodiment includes an image forming unit 151K having the black color of the toner 4, and the image forming unit 151K is disposed in facing to other image forming units. The other configurations of the image forming apparatus 2700 are substantially similar to those of the image forming apparatus 1 of the first embodiment. Since the print operation of the fourth embodiment is also substantially similar to that of the first embodiment, description thereof will be omitted while an element, a configuration and an operation of the image forming apparatus 2700 that differ from those of the above first embodiment will be described.

Figure 14:
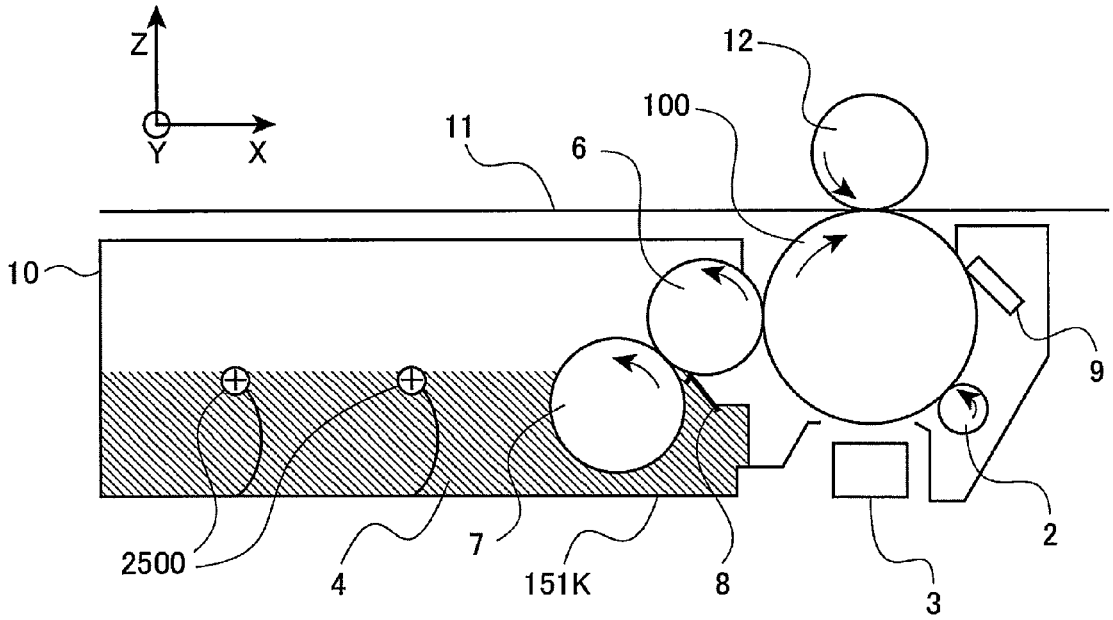
FIG. 14 is a schematic diagram illustrating an image forming unit included in the image forming apparatus according to the fourth embodiment of the present invention.

The image forming unit 151K is relatively long in the X-axis direction as illustrated in FIG. 14 compared to the image forming unit 15K of the first embodiment, thereby capable of having a relatively large volume of the black toner 4 accumulated therein.

Figure 15:
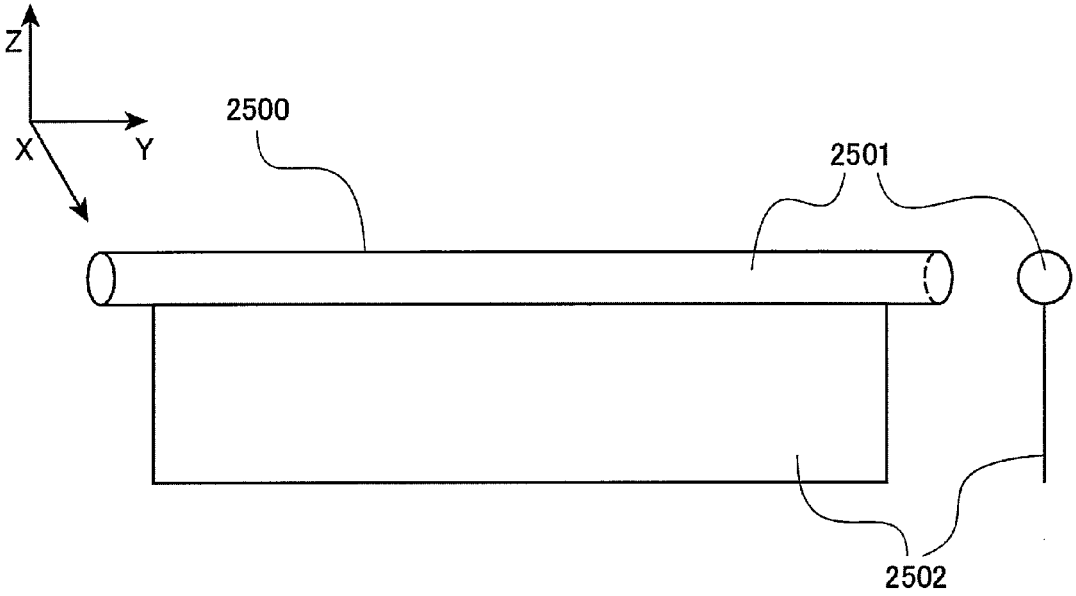
FIG. 15 is a schematic diagram illustrating an example of a toner conveyance member included in the image forming apparatus according to the fourth embodiment of the present invention.

A toner conveyance member 2500 conveys the toner 4 of black accumulated in the X-axis direction to the toner supply roller 7, and includes a shaft 2501 and resin film 2502 that is integrally formed with the shaft 2501 as illustrated in FIG. 15. A material for each of the shaft 2501 and the resin film 2502 is not particularly defined. However, the shaft 2501 may be prepared using an ABS (acrylonitrile-butadiene-styrene) resin or metal, and the resin film 2501 may be prepared using, for example, PET (polyethylene terephthalate).

Figure 16:
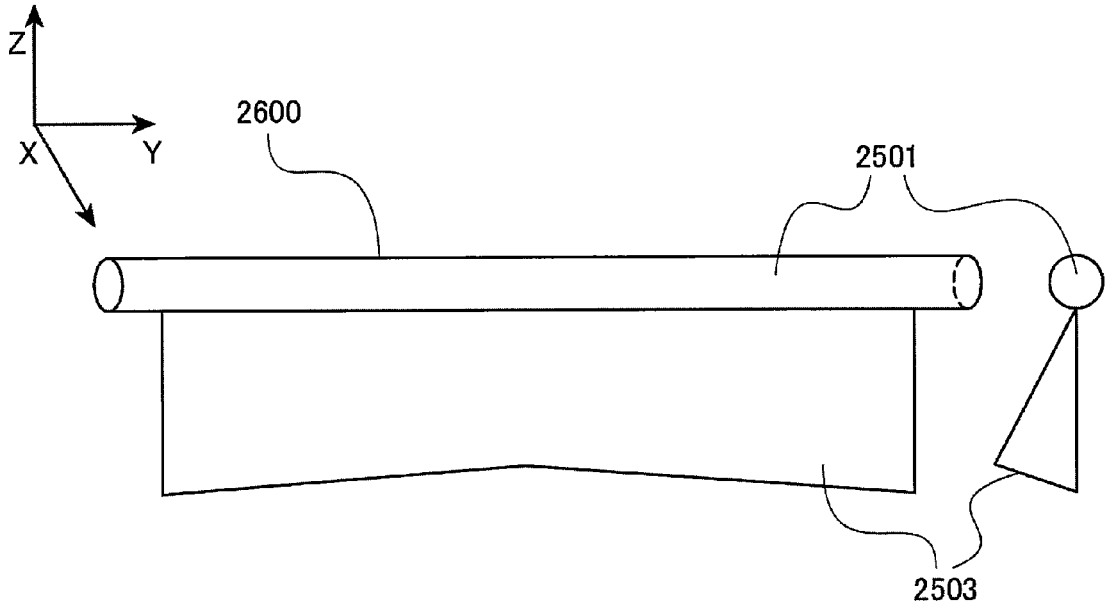
FIG. 16 is another schematic diagram illustrating an example of a toner conveyance member included in the image forming apparatus according to the fourth embodiment of the present invention.

The toner conveyance member 2500 may include, for example, a resin film 2503 having a chevron shape protruding toward a tip of a middle portion thereof in a Z-axis minus direction as illustrated in FIG. 16 in such a manner to reduce a difference of a charge characteristic between the toner 4 of black accumulated both ends of the image forming unit in the Y-axis direction and the toner 4 of black accumulated at a middle portion in the image forming unit.

The print data are received, and the shaft 2501 provided with drive force through a driving source, a gear, and the like (not shown) based on an instruction of the print control unit 51 begins to rotate by the drive force. Subsequently, the resin film 2502 integrally formed with the shaft 2501 begins to rotate, and the toner 4 of the black accumulated in the X-axis direction is conveyed to the supply roller 7 by the rotation force of the resin film 2502. The other print operations are substantially the same as the operations described in the first embodiment.

Generally, regarding toner inside an image forming unit, the toner accumulated in a middle portion of the image forming unit is more frequently used. Therefore, the toner accumulated in the middle portion of the image forming unit is often used before deterioration thereof while the toner accumulated in both ends of the image forming unit increases a likelihood of deterioration thereof before being used. Consequently, the toner accumulated in both ends inside the image forming unit is preferably brought to the middle portion and not accumulated in both end portions.

Therefore, the toner conveyance member 2600 is shaped as illustrated in FIG. 16, so that the toner is supplied from both end sides of the resin film 2503 in the Y-axis direction and then is supplied from a middle portion of the resin film 2503 regarding a toner conveyance sequence with respect to the toner supply roller 7. That is, the toner is supplied to the toner supply roller 7 from the both end sides of the resin film 2503 before being supplied from the middle portion of the resin film 2503. Therefore, use of the conveyance member 2600 simultaneously allows the supply of the toner to the toner supply roller 7 and movement of the toner accumulated in both ends of the image forming unit to the middle portion thereof.

Therefore, according to the fourth embodiment described above, the image forming apparatus 2700 can reduce a number of replacement times of the image forming unit including the toner of black being frequently used. Since the image forming apparatus 2700 includes the toner conveyance member 2500 disposed inside the image forming unit 151K, the toner can be evenly conveyed in the X-axis direction inside the image forming unit 151K. Therefore, the image forming apparatus 2700 can reduce (if not eliminate) an occurrence of the toner deterioration and can reduce (if not prevent) the deterioration of the print quality when an image forming unit being long in the X-axis direction such as the image forming unit 151K is employed.

Moreover, the image forming apparatus 2700 employs the toner conveyance member 2600 shaped as illustrated in FIG. 16, so that the toner accumulated in both ends of the image forming unit is conveyed to the middle portion of the image forming unit, thereby reducing (if not eliminating) an occurrence of deteriorating the toner inside the image forming unit.

In addition to the configurations described in the first through fourth embodiments, an electrical potential to be applied to a transfer roller disposed such that the toner is transferred to the transfer belt from a lower portion or in a horizontal direction may be higher than an electrical potential to be applied to a transfer roller disposed such that the toner is transferred to the transfer belt from an upper portion. Such a configuration allows the toner transferred to the transfer belt from the lower portion to be stably attached on the transfer belt.

As can be appreciated by those skilled in the art, numerous additional modifications and variation of the present invention are possible in light of the above-described teachings. It is therefore to be understood that, within the scope of the appended claims, the disclosure of this patent specification may be practiced otherwise than as specifically described herein.

What is claimed is:

1. An image forming apparatus comprising:

a plurality of image forming units forming a visible image by attaching charged developer to an electrostatic latent image;

a transfer belt member that has the visible image formed by each of the plurality of image forming units transferred thereto;

a plurality of tension members tightly stretching the transfer belt member;

a primary transfer member transferring the visible image formed by the plurality of image forming units to the transfer belt member;

a secondary transfer member transferring the visible image transferred to the transfer belt member to a recording medium; and a fixing unit fixing the visible image transferred to the recording medium, wherein the plurality of image forming units are disposed in at least two transfer regions formed by segmenting the transfer belt member by the plurality of the tension members, and wherein at least one of the tension members disposed between an image forming unit positioned at a most upperstream side in a print direction and an image forming unit positioned at a most downstream side in the print direction is applied with an electrical potential of a polarity reverse to a polarity of an electrical potential charged to the developer.

2. The image forming apparatus according to claim 1, wherein at least one of the tension members disposed opposite to the secondary transfer member is applied with an electrical potential of the same polarity as the electrical potential charged at the developer.

3. The image forming apparatus according to claim 1, wherein at least one of the image forming units is disposed facing, through the transfer belt, another one of the image forming units being disposed in a transfer region different from a transfer region to which the one of the image forming units is provided.

4. The image forming apparatus according to claim 1, wherein at least one of the image forming units disposed on the most downstream side of a movement direction of the transfer belt member includes black developer.

5. The image forming apparatus according to claim 1, wherein the image forming units are disposed in the transfer regions excluding a transfer region not most adjacent to the fixing unit.

6. The image forming apparatus according to claim 4, further comprising a cleaning member disposed between at least one of the image forming units disposed on the most downstream side in a print direction and at least one of the tension members disposed opposite to the secondary transfer member.

7. The image forming apparatus according to claim 4, further comprising a cleaning member disposed between at least one of the tension members disposed opposite to the secondary transfer member and at least one of the tension members disposed at the most upperstream side in a print direction.

8. The image forming apparatus according to claim 4, wherein the secondary transfer member is applied with a potential reverse to an electrical potential charged at the developer when an image is formed using only the image forming unit including the black developer.

9. The image forming apparatus according to claim 4, wherein only the image forming unit having the black developer is disposed in the transfer region facing the other image forming units through the transfer belt.

10. The image forming apparatus according to claim 9, wherein the image forming unit having the black developer has a larger developer volume than that of any of the other image forming units.

11. The image forming apparatus according to claim 1, wherein a detachable direction of the image forming units is substantially parallel to an axial direction of the primary transfer member.

12. The image forming apparatus according to claim 1, wherein at least one of the image forming units and the primary transfer member are disposed opposite to each other through the transfer belt member, and an electrical potential applied to the primary transfer member, in a case where the transfer belt member is disposed in a direction opposite to or parallel to gravity exerted to the developer transferred to the transfer belt from the image forming units, is higher than an electrical potential applied to the primary transfer member in a case where the transfer belt member is disposed in a direction of the gravity exerted to the developer.

* * * * *